US010935908B1

(12) United States Patent
Seko et al.

(10) Patent No.: US 10,935,908 B1
(45) Date of Patent: Mar. 2, 2021

(54) TRANSFER UNIT, TRANSFER DEVICE, AND IMAGE FORMING APPARATUS

(71) Applicant: FUJI XEROX CO., LTD., Tokyo (JP)

(72) Inventors: Masayuki Seko, Kanagawa (JP); Shigeru Fukuda, Kanagawa (JP); Satoya Sugiura, Kanagawa (JP); Daisuke Tanemura, Kanagawa (JP); Masato Ono, Kanagawa (JP); Masato Furukawa, Kanagawa (JP); Hiroaki Tanaka, Kanagawa (JP); Shogo Hayashi, Kanagawa (JP); Koichi Matsumoto, Kanagawa (JP); Daisuke Tano, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/845,441

(22) Filed: Apr. 10, 2020

(30) Foreign Application Priority Data

Dec. 6, 2019 (JP) ..... JP2019-221324

(51) Int. Cl.
*G03G 15/16* (2006.01)
*G03G 15/08* (2006.01)
*G03G 15/02* (2006.01)

(52) U.S. Cl.
CPC ..... *G03G 15/162* (2013.01); *G03G 15/02* (2013.01); *G03G 15/0865* (2013.01); *G03G 15/161* (2013.01)

(58) Field of Classification Search
CPC .... G03G 15/161; G03G 15/162; G03G 15/02; G03G 15/0865
See application file for complete search history.

(56) References Cited

U.S. PATENT DOCUMENTS

2010/0021216 A1* 1/2010 Sawai ..... G03G 15/162 399/302
2018/0059595 A1* 3/2018 Akiyama ..... G03G 15/1615

FOREIGN PATENT DOCUMENTS

JP 2007-11117 A 1/2007
JP 2007-78789 A 3/2007

* cited by examiner

*Primary Examiner* — Sophia S Chen
(74) *Attorney, Agent, or Firm* — Sughrue Mion, PLLC

(57) ABSTRACT

A transfer unit includes an intermediate transfer belt including a resin and in which in a spatial distribution of conductive carbon particles that are present in an evaluation region of 6.3 μm×4.2 μm on an outer peripheral surface, an integrated value of a statistic L(r) in an interparticle distance r of 0.05 μm or more and 0.30 μm or less is 0 or more and 0.1 or less; and a cleaning component including a cleaning blade which contacts the outer peripheral surface of the intermediate transfer belt and in which a value of M100/Re is 0.25 or more and a value of Re is 25 or more where M100 represents a 100% modulus (MPa) of a contact portion of the cleaning blade contacts the intermediate transfer belt, and Re represents a rebound resilience coefficient (%) of the contact portion:

$$L(r):=\sqrt{K(r)/\pi}-r \tag{1}$$

$$K(r) := \frac{\sum_{i\neq j}^{N} 1(|X_i - X_j| \leq r)/s(|X_i - X_j|)}{\lambda^2}. \tag{2}$$

$$s(x) := L_x L_y - \frac{x}{\pi}(2L_x + 2L_y - x). \tag{3}$$

20 Claims, 1 Drawing Sheet

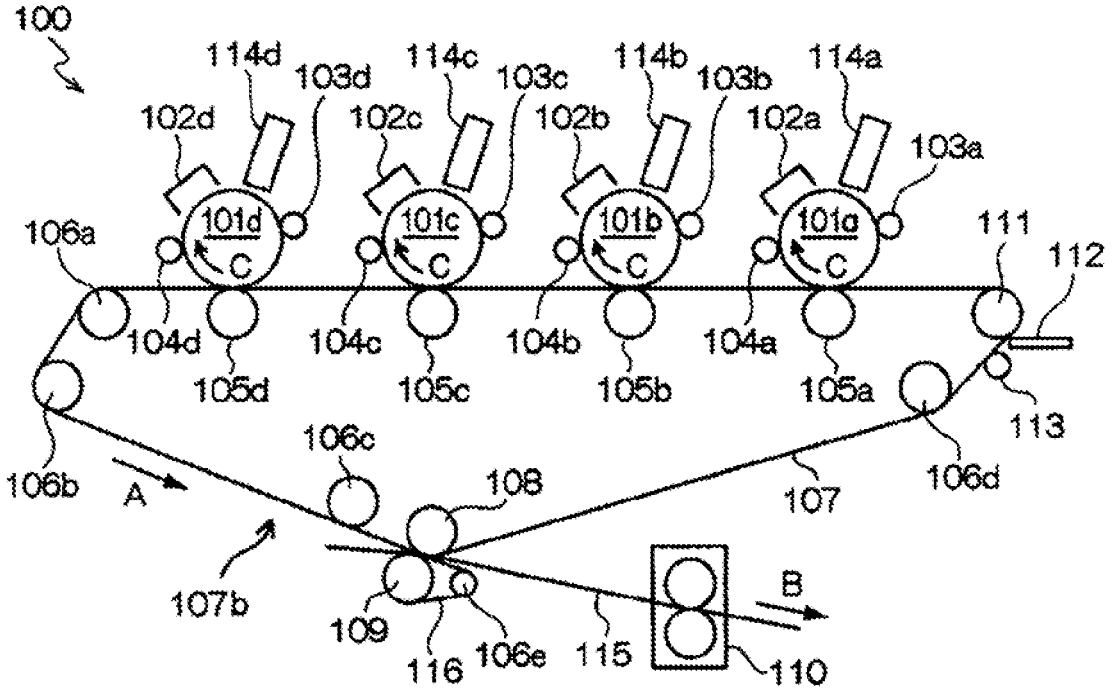
100
114d
103d
114c
103c
114b
103b
114a
102d
102c
102b
102a
103a
101d
101c
101b
101a
C
106a
111
112
104d
104c
104b
104a
105d
105c
105b
105a
113
106b
A
106c
108
107
106d
107b
109
116
106e
115
B
110

TRANSFER UNIT, TRANSFER DEVICE, AND IMAGE FORMING APPARATUS

CROSS-REFERENCE TO RELATED APPLICATIONS

This application is based on and claims priority under 35 USC 119 from Japanese Patent Application No. 2019-221324 filed Dec. 6, 2019.

BACKGROUND

(i) Technical Field

The present disclosure relates to a transfer unit, a transfer device, and an image forming apparatus.

(ii) Related Art

In electrophotographic image forming apparatuses (such as a copying machine, a facsimile, and a printer), an image is formed by transferring a toner image formed on a surface of an image carrier to a surface of a recording medium and fixing the toner image to the recording medium. When such a toner image is transferred to a recording medium, a conductive endless belt, such as an intermediate transfer belt, is used.

For example, Japanese Unexamined Patent Application Publication No. 2007-011117 discloses "an intermediate transfer belt having at least a surface layer on a base, in which the surface layer contains aggregates of conductive particles, the aggregates having an average particle size of 0.5 to 25 μm".

Japanese Unexamined Patent Application Publication No. 2007-078789 discloses "an intermediate transfer belt having at least a surface layer on a base, in which the surface layer contains a resin fine particle coated with a metal".

SUMMARY

In an image forming apparatus in which an endless belt is used as an intermediate transfer belt, in the case of using a recording medium with large surface irregularities (hereinafter, also referred to as "textured paper") such as embossed paper, when a toner image is transferred from the intermediate transfer belt to the recording medium, the intermediate transfer belt cannot conform to the irregularities of the recording medium, and transferability decreases, which may result in print defects of the image density. Therefore, it is desirable to maintain a state of good transferability to textured paper even when an intermediate transfer belt cannot conform to irregularities of a recording medium.

Aspects of non-limiting embodiments of the present disclosure relate to a transfer unit having a high ability to maintain transferability to textured paper compared with the case where an integrated value of a statistic L(r) in an intermediate transfer belt is less than 0.1 and a value of M100/Re in a cleaning blade is less than 0.25 or in the case where an integrated value of a statistic L(r) in an intermediate transfer belt is less than 0.1 and a value of Re in a cleaning blade is less than 25.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer unit including an intermediate transfer belt which is an endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less; and a cleaning component that cleans the outer peripheral surface of the intermediate transfer belt, the cleaning component including a cleaning blade which comes in contact with the outer peripheral surface of the intermediate transfer belt and in which a value of M100/Re is 0.25 or more and a value of Re is 25 or more where M100 represents a 100% modulus (MPa) of a contact portion of the cleaning blade that comes in contact with the intermediate transfer belt, and Re represents a rebound resilience coefficient (%) of the contact portion.

$$L(r):=\sqrt{K(r)/\pi}-r \tag{1}$$

In the formula (1), r represents the interparticle distance, and K(r) represents a Ripley's K function K(r) represented by a formula (2) below.

$$K(r):=\frac{\sum_{i\neq j}^{N} 1(|X_i-X_j|\leq r)/s(|X_i-X_j|)}{\lambda^2} \tag{2}$$

In the formula (2), $1(|X_i-X_j|\leq r)$ represents an indicator function; $X_i$ and $X_j$ represent coordinates of a point i and a point j, respectively; $|X_i-X_j|$ represents a Euclidean distance between the coordinates $X_i$ and the coordinates $X_j$; r represents the interparticle distance; $s(|X_i-X_j|)$ represents an edge correction factor s(x) in the evaluation region, the edge correction factor s(x) being represented by a formula (3) below, where $x=|X_i-X_j|$; N represents a total number of particles in the evaluation region; and λ represents a number density of particles in the evaluation region.

$$s(x):=L_xL_y-\frac{x}{\pi}(2L_x+2L_y-x) \tag{3}$$

In the formula (3), $L_x$ and $L_y$ represent a length (μm) of a side of the evaluation region in an x-axis direction and a length (μm) of a side of the evaluation region in a y-axis direction, respectively; $x=|X_i-X_j|$; $X_i$ and $X_j$ represent coordinates of the point i and the point j, respectively; and $|X_i-X_j|$ represents the Euclidean distance between the coordinates $X_i$ and the coordinates $X_j$.

BRIEF DESCRIPTION OF THE DRAWING

Exemplary embodiments of the present disclosure will be described in detail based on the following FIGURE, wherein:

FIGURE is a schematic diagram illustrating an example of an image forming apparatus according to an exemplary embodiment.

DETAILED DESCRIPTION

Exemplary embodiments will be described below. The following description and Examples are illustrative of the exemplary embodiments and are not intended to limit the scope of the exemplary embodiments.

In numerical ranges described in a stepwise manner in the exemplary embodiments, the upper limit value or the lower limit value of a numerical range may be replaced with the upper limit value or the lower limit value of another numerical range described in a stepwise manner. In a numerical range described in the exemplary embodiments, the upper limit value or the lower limit value of the numerical range may be replaced with the upper limit value or the lower limit value described in Examples below.

In the exemplary embodiments, the term "step" refers not only to an independent step but also to a step that is not clearly distinguishable from other steps as long as an intended purpose of the step is achieved.

In the exemplary embodiments, when an exemplary embodiment is described with reference to a drawing, the configuration of the exemplary embodiment is not limited to the configuration illustrated in the drawing. The sizes of the members illustrated in the drawing are conceptual, and the relative relations between the sizes of the members are not limited to these relations.

In the exemplary embodiments, any component may include plural types of substances corresponding to the component. In the exemplary embodiments, when plural types of substances corresponding to a component are present in a composition, the amount of the component in the composition means the total amount of the plural types of substances that are present in the composition, unless otherwise specified.

Transfer Unit

A transfer unit according to an exemplary embodiment includes an intermediate transfer belt which is an endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less; and a cleaning component that cleans the outer peripheral surface of the intermediate transfer belt, the cleaning component including a cleaning blade which comes in contact with the outer peripheral surface of the intermediate transfer belt and in which a value of M100/Re is 0.25 or more and a value of Re is 25 or more where M100 represents a 100% modulus (MPa) of a contact portion of the cleaning blade that comes in contact with the intermediate transfer belt, and Re represents a rebound resilience coefficient (%) of the contact portion. The transfer unit may be configured to be detachably attached to an image forming apparatus.

$$L(r) := \sqrt{K(r)/\pi} - r \tag{1}$$

In the formula (1), r represents the interparticle distance, and K(r) represents a Ripley's K function K(r) represented by a formula (2) below.

$$K(r) := \frac{\sum_{i \neq j}^{N} 1(|X_i - X_j| \leq r)/s(|X_i - X_j|)}{\lambda^2} \tag{2}$$

In the formula (2), $1(|X_i-X_j| \leq r)$ represents an indicator function; $X_i$ and $X_j$ represent coordinates of a point i and a point j, respectively; $|X_i-X_j|$ represents a Euclidean distance between the coordinates $X_i$ and the coordinates $X_j$; r represents the interparticle distance; $s(|X_i-X_j|)$ represents an edge correction factor s(x) in the evaluation region, the edge correction factor s(x) being represented by a formula (3) below, where $x=|X_i-X_j|$; N represents a total number of particles in the evaluation region; and λ represents a number density of particles in the evaluation region.

$$s(x) := L_x L_y - \frac{x}{\pi}(2L_x + 2L_y - x) \tag{3}$$

In the formula (3), $L_x$ and $L_y$ represent a length (μm) of a side of the evaluation region in an x-axis direction and a length (μm) of a side of the evaluation region in a y-axis direction, respectively; $x=|X_i-X_j|$; $X_i$ and $X_j$ represent coordinates of the point i and the point j, respectively; and $|X_i-X_j|$ represents the Euclidean distance between the coordinates $X_i$ and the coordinates $X_j$.

Hereinafter, in the spatial distribution of the conductive carbon particles that are present in the evaluation region of 6.3 μm×4.2 μm on the outer peripheral surface of the endless belt, the integrated value of the statistic L(r) represented by the formula (1) in an interparticle distance r of 0.05 μm or more and 0.30 μm or less is also referred to as an "L(r) integrated value".

In the present specification, "conductive" means that a volume resistivity at 20° C. is less than $1\times10^{13}$ Ωcm.

Herein, the spatial distribution of the conductive carbon particles is obtained by observing the outer peripheral surface of the endless belt with a scanning electron microscope (for example, model number: SU8010 available from Hitachi High-Tech Corporation) at a magnification of 20,000, and binarizing the obtained 256 gradation image at a threshold of 128 by using analysis software (for example, free software "ImageJ") as required. Subsequently, the statistic L(r) in the interparticle distance r of 0.05 μm or more and 0.30 μm or less is calculated for every 0.05 m on the basis of the above formula to determine the integrated value in the range of 0.05 μm or more and 0.30 μm or less.

The 100% modulus M100 (MPa) is a value determined from the stress at a strain of 100% measured at a tensile speed of 500 mm/min by using a dumbbell-shaped No. 3 specimen in accordance with JIS K6251 (2010). For example, STROGRAPH AE ELASTOMER available from Toyo Seiki Seisaku-sho, Ltd. is used as a measuring device.

The rebound resilience coefficient is a value determined by using a LUPKE rebound resilience tester in an environment at 23° C. in accordance with JIS K6255 (1996)

In the present exemplary embodiment, a high ability to maintain transferability to textured paper is achieved because the L(r) integrated value of the intermediate transfer belt is 0 or more and 0.1 or less, the value of M100/Re of the contact portion of the cleaning blade that comes in contact with the intermediate transfer belt is 0.25 or more, and the value of Re of the contact portion is 25 or more. The reasons for this are not clear and may be the following.

In an image forming apparatus in which an endless belt is used as an intermediate transfer belt, in the case of using textured paper as a recording medium, when a toner image is transferred from the intermediate transfer belt to the recording medium, the intermediate transfer belt cannot conform to irregularities of the recording medium, and transferability decreases, which may result in print defects of the image density. Specifically, for example, when the electric field during transfer is increased because a sufficient transfer electric field is unlikely to be formed in recessed portions of the recording medium, an excessive electric field is locally applied to projecting portions of the recording medium, and abnormal discharge occurs. As a result, transferability may be decreased by a decrease in the charge amount or reverse charging of a toner. In particular, the decrease in transferability tends to occur in tandem image forming apparatuses in which a multicolor image obtained by overprinting plural single-color images on an intermediate transfer belt is transferred from the intermediate transfer belt to a recording medium, and in particular, among such tandem image forming apparatuses, in image forming apparatuses in which a toner having a small particle size is used.

Furthermore, even in the case where an endless belt that initially has good transferability to textured paper is used as an intermediate transfer belt, if substances adhere to the outer peripheral surface of the intermediate transfer belt with the formation of images, abnormal discharge may be easily caused by the adhering substances.

In contrast, in the transfer unit according to the present exemplary embodiment, the L(r) integrated value of the intermediate transfer belt is 0 or more and 0.1 or less, the value of M100/Re of the contact portion of the cleaning blade that comes in contact with the intermediate transfer belt is 0.25 or more, and the value of Re of the contact portion is 25 or more.

Accordingly, first, conductive carbon particles are finely dispersed on the outer peripheral surface of the intermediate transfer belt. In addition, even if the intermediate transfer belt cannot conform to irregularities of a recording medium and an excessive electric field is locally applied to projecting portions of textured paper, small discharge occurs in each of conductive points that are finely dispersed on the outer peripheral surface of the intermediate transfer belt, and thus the discharge is dispersed. Consequently, a decrease in the charge amount or reverse charging of a toner due to abnormal discharge is suppressed to improve transferability.

When substances adhere to the outer peripheral surface of the intermediate transfer belt as the intermediate transfer belt is used, the dispersion of discharge caused by the fine conductive points may be disturbed. However, in the present exemplary embodiment, the value of M100/Re of a contact portion is 0.25 or more, and the value of Re is 25 or more. As a result, a cleaning blade satisfactorily forms a micro-tucked-under space with respect to the intermediate transfer belt. Herein, the "micro-tucked-under space" refers to a very small wedge-shaped space that is formed, in the case where cleaning is performed by bringing a contact portion which is an end portion of the cleaning blade into contact with the outer peripheral surface of the intermediate transfer belt from a direction opposite to a transport direction of the intermediate transfer belt, when the contact portion of the cleaning blade is caught in the transport direction of the intermediate transfer belt. In the present exemplary embodiment, the micro-tucked-under space is maintained, thereby scraping off substances adhering to the surface of the intermediate transfer belt. Thus, good cleanability of the intermediate transfer belt is realized. Accordingly, it is considered that good transferability to textured paper, the transferability being achieved due to the L(r) integrated value of the intermediate transfer belt of 0 or more and 0.1 or less, is easily maintained.

Hereafter, the endless belt used as the intermediate transfer belt and the cleaning blade used as the cleaning component will be described.

Intermediate Transfer Belt

The endless belt used as the intermediate transfer belt includes a resin and conductive carbon particles, in which the integrated value of L(r) is 0 or more and 0.1 or less.

The endless belt may be a single-layer product or a multilayer product.

When the endless belt is a single-layer product, the single-layer product is a layer which includes a resin and conductive carbon particles and in which the integrated value of L(r) is 0 or more and 0.1 or less.

When the endless belt is a multilayer product, the multilayer product has, for example, a base layer and a surface layer disposed on the base layer. The surface layer is the outermost layer of the endless belt. The multilayer product may have another layer between the base layer and the surface layer.

When the endless belt is a multilayer product having a base layer and a surface layer, the surface layer is a layer which includes a resin and conductive carbon particles and in which the integrated value of L(r) is 0 or more and 0.1 or less. The base layer is not particularly limited, and an example thereof is a layer that includes a resin for a base layer and conductive carbon particles for a base layer.

Hereinafter, a layer of an endless belt which is a single-layer product is also referred to as a "single layer". In an endless belt which is a multilayer product, a surface layer that includes a resin and conductive carbon particles is also referred to as a "first layer", and a base layer that includes a resin for a base layer and conductive carbon particles for a base layer is also referred to as a "second layer". Furthermore, the resin and the conductive carbon particles that are included in the single layer or the first layer are also referred to as a "first resin" and "first conductive carbon particles", respectively. The resin for a base layer and the conductive carbon particles for a base layer, the resin and the conductive carbon particles being included in the second layer, are also referred to as a "second resin" and "second conductive carbon particles", respectively.

Resin

Examples of the first resin included in the single layer or the first layer include polyimide resins (PI resins), polyamide-imide resins (PAI resins), aromatic polyether ketone resins (e.g., aromatic polyether ether ketone resins), polyphenylene sulfide resins (PPS resins), polyetherimide resins (PEI resins), polyester resins, polyamide resins, and polycarbonate resins. From the viewpoints of mechanical strength and dispersibility of the first conductive carbon particles, the first resin preferably includes at least one selected from the group consisting of polyimide resins, polyamide-imide resins, aromatic polyether ketone resins, polyetherimide resins, and polyphenylene sulfide resins and more preferably includes at least one selected from the group consisting of polyimide resins and polyamide-imide resins. Of these, polyimide resins are still more preferable from the viewpoint of mechanical strength. The first resin may be formed from one resin or a mixture of two or more resins.

Specific examples and preferred examples of the second resin included in the second layer are also the same as the specific examples and the preferred examples of the first resin. The second resin may be formed from one resin or a mixture of two or more resins.

In the case where the endless belt has the first layer and the second layer, the first resin and the second resin may be the same resin or different resins, and are preferably the same type of resin (for example, the first resin and the second resin are each preferably a polyimide resin).

Polyimide Resin

Examples of the polyimide resin include imidized products of polyamic acids (i.e., precursors of polyimide resins), which are polymerized products of a tetracarboxylic dianhydride and a diamine compound.

Examples of the polyimide resin include resins having a structural unit represented by a general formula (I) below.

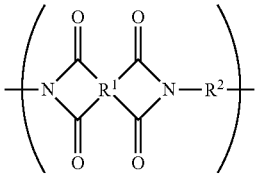

General formula (I)

In the general formula (I), $R^1$ represents a tetravalent organic group and $R^2$ represents a divalent organic group.

Examples of the tetravalent organic group represented by $R^1$ include aromatic groups, aliphatic groups, alicyclic groups, groups that include an aromatic group and an aliphatic group in combination, and groups formed by substituting any of the above groups with a substituent. Specific examples of the tetravalent organic group include residues of tetracarboxylic dianhydrides described below.

Examples of the divalent organic group represented by $R^2$ include aromatic groups, aliphatic groups, alicyclic groups, groups that include an aromatic group and an aliphatic group in combination, and groups formed by substituting any of the above groups with a substituent. Specific examples of the divalent organic group include residues of diamine compounds described below.

Specific examples of the tetracarboxylic dianhydride used as a raw material of a polyimide resin include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, and ethylenetetracarboxylic dianhydride.

Specific examples of the diamine compound used as a raw material of a polyimide resin include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-tert-butyl)toluene, bis(p-β-amino-tert-butylphenyl) ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

Polyamide-Imide Resin

Examples of the polyamide-imide resin include resins having a repeating unit including an imide bond and an amide bond.

Specific examples of the polyamide-imide resin include polymerized products of a trivalent carboxylic acid compound (also referred to as a tricarboxylic acid) having an acid anhydride group and a diisocyanate or diamine compound.

Examples of the tricarboxylic acid preferably include trimellitic anhydride and derivatives of trimellitic anhydride. The tricarboxylic acid may be used in combination with a tetracarboxylic dianhydride, an aliphatic dicarboxylic acid, an aromatic dicarboxylic acid, or the like.

Examples of the diisocyanate compound include 3,3'-dimethylbiphenyl-4,4'-diisocyanate, 2,2'-dimethylbiphenyl-4,4'-diisocyanate, biphenyl-4,4'-diisocyanate, biphenyl-3,3'-diisocyanate, biphenyl-3,4'-diisocyanate, 3,3'-diethylbiphenyl-4,4'-diisocyanate, 2,2'-diethylbiphenyl-4,4'-diisocyanate, 3,3'-dimethoxybiphenyl-4,4'-diisocyanate, 2,2'-dimethoxybiphenyl-4,4'-diisocyanate, naphthalene-1,5-diisocyanate, and naphthalene-2,6-diisocyanate.

Examples of the diamine compound include compounds that have a structure similar to that of any of the above isocyanates and that have amino groups instead of isocyanato groups.

Aromatic Polyether Ketone Resin

Examples of the aromatic polyether ketone resin include resins in which aromatic rings such as benzene rings are linearly bonded to each other with an ether bond and a ketone bond therebetween.

Examples of the aromatic polyether ketone resin include polyether ketones (PEK) in which an ether bond and a ketone bond are alternately arranged, polyether ether ketones (PEEK) in which an ether bond, an ether bond, and a ketone bond are arranged in this order, polyether ketone ketones (PEKK) in which an ether bond, a ketone bond, and a ketone bond are arranged in this order, polyether ether ketone ketones (PEEKK) in which an ether bond, an ether bond, a ketone bond, and a ketone bond are arranged in this order, and polyether ketone esters including an ester bond.

The content of the first resin relative to the entire single layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

The content of the first resin relative to the entire first layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

The content of the second resin relative to the entire second layer is preferably 60% by mass or more and 95% by mass or less, more preferably 70% by mass or more and 95% by mass or less, still more preferably 75% by mass or more and 90% by mass or less from the viewpoints of, for example, mechanical strength and adjustment of the volume resistivity.

Conductive Carbon Particles

An example of the first conductive carbon particles included in the single layer or the first layer is carbon black.

Examples of the carbon black include Ketjenblack, oil-furnace black, channel black (i.e., gas black), and acetylene black. Carbon black that has been subjected to surface treatment (hereinafter, also referred to as "surface-treated carbon black") may also be used as the carbon black.

The surface-treated carbon black is produced by providing, for example, a carboxy group, a quinone group, a lactone group, or a hydroxy group to the surface of carbon black. Examples of the surface treatment method include an air oxidation method in which carbon black is brought into contact and allowed to react with air in a high-temperature atmosphere, a method in which carbon black is allowed to react with a nitrogen oxide or ozone at room temperature (e.g., 22° C.), and a method in which carbon black is oxidized with air in a high-temperature atmosphere and then oxidized by ozone at a low temperature.

The first conductive carbon particles have a number-average primary particle size, for example, in the range of 20 nm or less. From the viewpoint of adjusting the L(r) integrated value to the above range, the number-average primary particle size of the first conductive carbon particles is preferably in the range of 18 nm or less, more preferably in the range of 15 nm or less, still more preferably in the range of 13 nm or less. The first conductive carbon particles have a number-average primary particle size, for example, in the range of 2 nm or more. From the viewpoint of adjusting the L(r) integrated value to the above range, the number-average primary particle size of the first conductive carbon particles is preferably in the range of 5 nm or more, more preferably in the range of 10 nm or more.

The second conductive carbon particles have a number-average primary particle size, for example, in the range of 2 nm or more and 40 nm or less. From the viewpoints of, for example, dispersibility, mechanical strength, volume resistivity, and film formability, the number-average primary particle size of the second conductive carbon particles is preferably in the range of 20 nm or more and 40 nm or less, more preferably in the range of 20 nm or more and 35 nm or less, still more preferably in the range of 20 nm or more and 28 nm or less.

In the case where the endless belt has the first layer and the second layer, the number-average primary particle size of the first conductive carbon particles may be smaller than the number-average primary particle size of the second conductive carbon particles. The number-average primary particle size of the first conductive carbon particles is preferably 0.5 times or more and less than 1.0 time, more preferably 0.5 times or more and 0.8 times or less, still more preferably 0.5 times or more and 0.7 times or less the number-average primary particle size of the second conductive carbon particles.

The number-average primary particle size of conductive carbon particles is measured by the following method.

First, a measurement sample having a thickness of 100 nm is taken from each layer of a prepared belt with a microtome. The measurement sample is observed with a transmission electron microscope (TEM). Subsequently, for each of 50 conductive carbon particles, the diameter of a circle having an area equal to the projected area (that is, equivalent circle diameter) is determined as a particle diameter of the conductive carbon particle. The average of the particle diameters of the 50 conductive carbon particles is defined as the number-average primary particle size.

In the case where the first resin includes at least one selected from the group consisting of polyimide resins and polyamide-imide resins and the single layer or the first layer is formed by using a first coating liquid described below, from the viewpoint of adjusting the L(r) integrated value to the above range, the first conductive carbon particles are preferably channel black, more preferably surface-treated channel black among the conductive carbon particles mentioned above.

When the single layer or the first layer is formed by using the first coating liquid, the pH of the first conductive carbon particles is, for example, in the range of 1.0 or more and 5.5 or less, and preferably in the range of 1.0 or more and 3.0 or less from the viewpoint of adjusting the L(r) integrated value to the above range.

When the second first layer is formed by using a second coating liquid described below, the pH of the second conductive carbon particles is, for example, in the range of 1.0 or more and 5.5 or less, and preferably in the range of 1.0 or more and 3.0 or less from the viewpoint of adjusting the L(r) integrated value to the above range.

In the case where the endless belt has the first layer formed by using the first coating liquid and the second layer formed by using the second coating liquid, the pH of the first conductive carbon particles is preferably lower than the pH of the second conductive carbon particles.

In the case where the first resin includes at least one selected from the group consisting of polyetherimide resins, aromatic polyether ether ketone resins, and polyphenylene sulfide resins and the single layer or the first layer is formed by melt extrusion described below, from the viewpoint of adjusting the L(r) integrated value to the above range, the first conductive carbon particles are preferably, among the conductive carbon particles mentioned above, channel black or furnace black, more preferably channel black or furnace black that is not subjected to surface treatment.

The first conductive carbon particles may be formed from one type of conductive carbon particles or a mixture of two or more types of conductive carbon particles.

Specific examples of the second conductive carbon particles included in the second layer also include conductive carbon particles similar to the specific examples of the first conductive carbon particles.

The content of the first conductive carbon particles relative to the entire single layer is preferably 10% by mass or more and 50% by mass or less, more preferably 13% by mass or more and 40% by mass or less, still more preferably 15% by mass or more and 30% by mass or less from the viewpoint of reducing the L(r) integrated value and ensuring strength.

The content of the first conductive carbon particles relative to the entire first layer is preferably 10% by mass or more and 50% by mass or less, more preferably 13% by mass or more and 40% by mass or less, still more preferably 15% by mass or more and 30% by mass or less from the viewpoint of reducing the L(r) integrated value and ensuring strength.

The content of the second conductive carbon particles relative to the entire second layer is preferably 5% by mass or more and 40% by mass or less, more preferably 10% by mass or more and 30% by mass or less, still more preferably 20% by mass or more and 30% by mass or less from the viewpoint of dispersibility, mechanical strength, and adjustment of volume resistivity.

Other Components

The single layer, the first layer, and the second layer may each include another component besides a resin and conductive carbon particles.

Examples of the other component include conductive agents other than the conductive carbon particles, fillers for improving strength of the belt, antioxidants for preventing the belt from being degraded by heat, surfactants for improving fluidity, and heat-resistant anti-aging agents.

In the case where the other component is included in any of the above layers, the content of the other component is preferably more than 0% by mass and 10% by mass or less, more preferably more than 0% by mass and 5% by mass or less, still more preferably more than 0% by mass and 1% by mass or less relative to the total mass of the layer including the other component.

Characteristics of Endless Belt

L(r) Integrated Value of Endless Belt

The L(r) integrated value of the endless belt is 0 or more and 0.1 or less. From the viewpoint of achieving good transferability to textured paper, the L(r) integrated value of the endless belt is preferably 0 or more and 0.08 or less, more preferably 0 or more and 0.06 or less.

Examples of the method for adjusting the L(r) integrated value to the above range include, but are not particularly limited to, a method of using conductive carbon particles having a small number-average primary particle size as the first conductive carbon particles, a method of selecting the type of first conductive carbon particles used, and a method of adjusting conditions (e.g., drying conditions) in the process of producing the endless belt.

Thickness of Endless Belt

The thickness of the single layer is preferably 60 μm or more and 120 μm or less, more preferably 80 μm or more and 120 μm or less from the viewpoint of mechanical strength of the belt.

The thickness of the first layer is preferably 1 μm or more and 40 μm or less, more preferably 3 μm or more and 20 μm or less from the viewpoint of production suitability and from the viewpoint of suppressing discharge.

The thickness of the second layer is preferably 50 μm or more and 100 μm or less, more preferably 60 μm or more and 80 μm or less from the viewpoint of mechanical strength of the belt.

In the case where the endless belt has the first layer and the second layer, the ratio of the thickness of the first layer relative to the total thickness is preferably 3% or more and 50% or less, more preferably 5% or more and 30% or less from the viewpoint of achieving good transferability to textured paper.

The thickness of each layer is measured as follows.

Specifically, a section of an endless belt in the thickness direction is observed with an optical microscope or a scanning electron microscope. The thickness of the layer to be measured is measured at 10 positions. The average of the thicknesses is defined as the thickness of the layer.

Volume Resistivity of Endless Belt

The common logarithm of a volume resistivity determined when a voltage of 100 V is applied to an endless belt for five seconds is preferably 9.0 (log Ω·cm) or more and 13.5 (log Ω·cm) or less, more preferably 9.5 (log Ω·cm) or more and 13.2 (log Ω·cm) or less, particularly preferably 10.0 (log Ω·cm) or more and 12.5 (log Ω·cm) or less from the viewpoint of achieving good transferability to textured paper.

The volume resistivity determined when a voltage of 100 V is applied to an endless belt for five seconds is measured by the following method.

A micro current meter (R8340A, available from Advantest Corporation) is used as a resistance measuring device, and a UR prove (available from Mitsubishi Chemical Analytech Co., Ltd.) is used as a probe. A volume resistivity (log Ω·cm) is measured by applying a voltage of 100 V and a pressure of 1 kgf for an application time of five seconds at 18 positions in total, specifically, at three positions of the center and both edges of an endless belt in the width direction with respect to six positions spaced at regular intervals in the circumferential direction. The average of the values of the volume resistivity is calculated. The measurement is performed in an environment at a temperature of 22° C. and a humidity of 55% RH.

Surface Resistivity of Endless Belt

The common logarithm of a surface resistivity determined when a voltage of 100 V is applied to an outer peripheral surface of an endless belt for three seconds is preferably 10.0 (log Ω/sq.) or more and 15.0 (log Ω/sq.) or less, more preferably 10.5 (log Ω/sq.) or more and 14.0 (log Ω/sq.) or less, particularly preferably 11.0 (log Ω/sq.) or more and 13.5 (log Ω/sq.) or less from the viewpoint of achieving good transferability to textured paper.

The unit log Ω/sq. of the surface resistivity represents a surface resistivity in terms of the common logarithm of a resistance value per unit area and is also expressed as, for example, log(Ω/sq.), log Ω/square, or log Ω/□.

The surface resistivity determined when a voltage of 100 V is applied to an outer peripheral surface of an endless belt for three seconds is measured by the following method.

A micro current meter (R8340A, available from Advantest Corporation) is used as a resistance measuring device, and a UR prove (available from Mitsubishi Chemical Analytech Co., Ltd.) is used as a probe. A surface resistivity (log Ω/sq.) of the outer peripheral surface of an endless belt is measured by applying a voltage of 100 V and a pressure of 1 kgf for an application time of three seconds at 18 positions in total, specifically, at three positions of the center and both edges of the outer peripheral surface of the endless belt in the width direction with respect to six positions spaced at regular intervals in the circumferential direction. The average of the values of the surface resistivity is calculated. The measurement is performed in an environment at a temperature of 22° C. and a humidity of 55% RH.

Method for Producing Endless Belt

The method for producing an endless belt is not particularly limited.

An example of the method for producing an endless belt include, for example, a first coating liquid preparation step of preparing a first coating liquid that contains a first resin or a precursor thereof, first conductive carbon particles, and a first solvent, a first coating film formation step of applying the first coating liquid to an outer periphery of an object to be coated to form a first coating film, and a first drying step of drying the first coating film while increasing a temperature of the object to be applied. The method for producing an endless belt may include another step other than the first coating liquid preparation step, the first coating film formation step, and the first drying step. For example, in the case where a precursor of the first resin is used, the other step may be a first baking step of baking the first coating film dried in the first drying step.

In the case of producing an endless belt which is a single-layer product, a single layer that includes a first resin and first conductive carbon particles is formed on an outer peripheral surface of an object to be coated, through the first coating liquid preparation step, the first coating film formation step, and the first drying step. The single layer may be, for example, a layer formed by producing pellets that include a first resin and first conductive carbon particles, and subjecting the pellets to melt extrusion.

In the case of producing an endless belt which is a multilayer product, a first layer that includes a first resin and first conductive carbon particles is formed on an outer peripheral surface of a second layer formed on an object to be coated, for example, through the first coating liquid preparation step, the first coating film formation step, and the first drying step.

In the case of producing an endless belt which is a multilayer product, a second layer is formed on an outer peripheral surface of an object to be coated, for example, through a second coating liquid preparation step of preparing a second coating liquid that contains a second resin or a precursor thereof, second conductive carbon particles, and a second solvent, a second coating film formation step of applying the second coating liquid to the outer periphery of the object to be coated to form a second coating film, and a second drying step of drying the second coating film. The second layer may be, for example, a layer formed by producing pellets that include a second resin and second conductive carbon particles, and subjecting the pellets to melt extrusion.

Coating Liquid Preparation Step

In the first coating liquid preparation step, a first coating liquid that contains a first resin or a precursor thereof, first conductive carbon particles, and a first solvent is prepared. For example, in the case where the first resin is a polyimide resin and the first conductive carbon particles are carbon black, for example, a solution in which the carbon black is dispersed and a polyamic acid which is a precursor of the polyimide resin is dissolved in the first solvent is prepared as the first coating liquid. For example, in the case where the first resin is a polyamide-imide resin and the first conductive carbon particles are carbon black, for example, a solution in which the carbon black is dispersed and the polyamide-imide resin is dissolved in the first solvent is prepared as the first coating liquid.

From the viewpoints of pulverizing aggregates of the first conductive carbon particles and enhancing dispersibility of the first conductive carbon particles, the first coating liquid may be prepared by a method including stirring conductive carbon particles with a planetary mixer, and subsequently performing dispersion treatment by using a pulverizer such as a ball mill or a jet mill.

The first solvent is not particularly limited and may be appropriately determined in accordance with, for example, the type of resin used as the first resin. For example, when the first resin is a polyimide resin or a polyamide-imide resin, polar solvents described below may be used as the first solvent.

Examples of the polar solvent include N-methyl-2-pyrrolidone (NMP), N,N-dimethylformamide (DMF), N,N-dimethylacetamide (DMAc), N,N-diethylacetamide (DEAc), dimethyl sulfoxide (DMSO), hexamethylphosphoramide (HMPA), N-methylcaprolactam, N-acetyl-2-pyrrolidone, and 1,3-dimethyl-2-imidazolidinone (N,N-dimethylimidazolidinone, DMI). These polar solvents may be used alone or in combination of two or more thereof.

In the case where the second coating liquid preparation step is performed, a second coating liquid that contains a second resin, second conductive carbon particles, and a second solvent is prepared in the second coating liquid preparation step. The second resin and the second conductive carbon particles are as described above. The method for preparing the second coating liquid and the second solvent are similar to the method for preparing the first coating liquid and the first solvent, respectively.

Coating Film Formation Step

In the first coating film formation step, the first coating liquid is applied to an outer periphery of an object to be coated to form a first coating film.

An example of the object to be coated is a cylindrical or columnar metal mold. The object to be coated may be an object produced by treating an outer peripheral surface of the metal mold with a release agent. In the case of producing an endless belt which is a single-layer product, in the first coating film formation step, the first coating liquid is directly applied, for example, to the outer peripheral surface of an object to be coated, the object being optionally treated with a release agent. In the case of producing an endless belt which is a multilayer product, in the first coating film formation step, the first coating liquid is applied, for example, to the outer peripheral surface of an object to be coated, the object having a second layer or a second coating film thereon.

Examples of the method for applying the first coating liquid include publicly known methods such as a spray coating method, a spiral coating method (flow coating method), a blade coating method, a wire bar coating method, a dip coating method, a bead coating method, an air knife coating method, and a curtain coating method.

In the case where the second coating film formation step is performed, in the second coating film formation step, a second coating film is formed by applying the second coating liquid to the outer periphery of the object to be coated. The method for applying the second coating liquid is also similar to the method for applying the first coating liquid.

Drying Step In the first drying step, the first coating film formed in the first coating film formation step is dried. Through the first drying step, the first solvent included in the first coating film is removed to provide a single layer or a first layer.

Examples of the method for drying the first coating film include a method including supplying hot air to the first coating film and a method including heating the object to be coated.

The speed of hot air on the surface of the first coating film is, for example, in the range of 0.1 m/s or more and 50.0 m/s or less, preferably in the range of 1.0 m/s or more and 40.0 m/s or less, more preferably in the range of 1.0 m/s or more and 20.0 m/s or less.

Herein, the speed of hot air on the surface of the first coating film is measured as described below. Specifically, the speed of hot air is measured by using an anemometer (ANEMOMASTER Model 6036, available from KANOMAX Incorporated).

The temperature of hot air on the surface of the first coating film is, for example, in the range of 50° C. or higher and 200° C. or lower, preferably in the range of 80° C. or higher and 185° C. or lower, more preferably in the range of 110° C. or higher and 170° C. or lower.

The temperature of hot air on the surface of the first coating film is measured by connecting a thermometer (e.g., K-type thermocouple, model number: JBS-7115-5M-K, available from GRAPHTEC Corporation) to a data recorder (model number: GL240, available from GRAPHTEC Corporation).

The method for supplying hot air to the surface of the first coating film include, but are not particularly limited to, a method including blowing hot air of a drying oven from a slit nozzle toward the surface of the first coating film, and a method including directly supplying hot air of a drying oven onto the first coating film. Of these, the method using a slit nozzle may be employed from the viewpoint of easily controlling the speed of the hot air on the surface of the first coating film.

In the case where the second drying step is performed, the second coating film formed in the second coating film formation step is dried in the second drying step. The method for drying the second coating film is similar to the method for drying the first coating film. The second drying step may be completed before the first coating film formation step is performed. Alternatively, the first coating film formation step may be performed before the completion of the second drying step, and the first drying step may also function as part of the second drying step.

Baking Step

As described above, the method for producing an endless belt may include a first baking step. In the first baking step, the first coating film dried in the first drying step is baked by heating. For example, in the case where the first resin is a polyimide resin, a polyamic acid included in the first coating film is imidized in the first baking step to provide a polyimide.

The heating temperature in the first baking step is, for example, in the range of 150° C. or higher and 450° C. or lower, preferably in the range of 200° C. or higher and 430° C. or lower. The heating time in the first baking step is, for example, in the range of 20 minutes or more and 180 minutes or less, preferably in the range of 60 minutes or more and 150 minutes or less.

In the case where an endless belt which is a multilayer product is produced and a second layer is formed through the second coating liquid preparation step, the second coating film formation step, and the second drying step, a second baking step of baking the second coating film dried in the second drying step may be performed. The second baking step may also function as the first baking step.

Cleaning Blade

A cleaning blade used as a cleaning component is not particularly limited as long as the cleaning blade is a cleaning blade which comes in contact with an outer peripheral surface of an intermediate transfer belt and in which a value of M100/Re in a contact portion that comes in contact with the intermediate transfer belt is 0.25 or more and a value of Re is 25 or more.

Hereinafter, a member having a value of M100/Re of 0.25 or more and a value of Re of 25 or more is also referred to as a "contact member".

Structure

The cleaning blade may have a single-layer structure, a two-layer structure, a three or more-layer structure, or another structure.

An example of the cleaning blade having a single-layer structure is a cleaning blade, the whole of which including a contact portion is formed of a single material (that is, a cleaning blade constituted by a contact member).

An example of the cleaning blade having a two-layer structure is a cleaning blade including a first layer that includes a contact portion, is formed over the entire surface on the front surface side, and is formed of a contact member and a second layer serving as a back surface layer that is formed closer to the back surface side than the first layer and is formed of a material different from the contact member.

An example of the cleaning blade having a three or more-layer structure is a cleaning blade having another layer between the first layer and the second layer in the cleaning blade having the two-layer structure.

The cleaning blade is used, for example, by being bonded to a rigid plate-like support member.

Composition of Contact Member

The contact member is not particularly limited as long as the value of M100/Re is 0.25 or more, and the value of Re is 25 or more.

The contact member is, for example, a member containing polyurethane rubber.

Polyurethane Rubber

The polyurethane rubber is polyurethane rubber produced by polymerization of at least a polyol component and a polyisocyanate component. The polyurethane rubber may be polyurethane rubber produced by polymerization of, other than the polyol component, a resin having a functional group capable of reacting with an isocyanate group of polyisocyanate, as required.

The polyurethane rubber may have a hard segment and a soft segment. Herein, the "hard segment" refers to a segment formed of a material harder than a material constituting the soft segment in a polyurethane rubber material, and the "soft segment" refers to a segment formed of a material softer than a material constituting the hard segment in the polyurethane rubber material. Herein, the "hard segment" and "soft segment" refer to segments of the polyurethane rubber materials, in which the material constituting the former segment is relatively harder than the material constituting the latter segment, and the material constituting the latter segment is relatively softer than the material constituting the former segment.

Examples of the material (hard segment material) constituting the hard segment include low-molecular-weight polyol components among polyol components and resins that have a functional group capable of reacting with an isocyanate group of polyisocyanate. Examples of the material (soft segment material) constituting the soft segment include high-molecular-weight polyol components among polyol components.

The average particle size of aggregates of the hard segment is preferably 1 μm or more and 10 μm or less, more preferably 1 μm or more and 5 μm or less.

When the aggregates of the hard segment have an average particle size of 1 μm or more, the frictional resistance of the surface of the contact member is easily reduced. Accordingly, the behavior of the blade is stabilized, and local abrasion is easily suppressed.

On the other hand, when the aggregates of the hard segment have an average particle size of 10 μm or less, the occurrence of chipping is easily suppressed.

The average particle size of the aggregates of the hard segment is measured as follows. An image is taken at a magnification of 20 by using a polarization microscope (BX51-P available from Olympus Corporation), and the image is binarized by image processing. The particle sizes (equivalent circle diameters) of aggregates are measured at five points (particle sizes of 5 aggregates per point) of each cleaning blade. The particle sizes of aggregates of 20 cleaning blades are measured, and the average particle size is calculated from a total of 500 aggregates.

In this measurement, the image is binarized by using image processing software OLYMPUS Stream essentials (available from Olympus Corporation), and threshold values of the hue/saturation/brightness are adjusted such that a crystal portion and a hard segment aggregate are black, and an amorphous portion (corresponding to a soft segment) is white.

Polyol Component

The polyol component includes a high-molecular-weight polyol and a low-molecular-weight polyol.

The high-molecular-weight polyol component is a polyol having a number-average molecular weight of 500 or more (preferably 500 or more and 5,000 or less). Examples of the high-molecular-weight polyol component include known polyols such as a polyester polyol produced by dehydration condensation of a low-molecular-weight polyol and a dibasic acid, a polycarbonate polyol produced by reaction between a low-molecular-weight polyol and an alkyl carbonate, a polycaprolactone polyol, and a polyether polyol. Examples of commercially available products of the high-molecular-weight polyol include PLACCEL 205 and PLACCEL 240 available from Daicel Corporation.

The number-average molecular weight is the value measured by gel permeation chromatography (GPC). The same applies hereinafter.

These high-molecular-weight polyols may be used alone or in combination of two or more thereof.

The polymerization ratio of the high-molecular-weight polyol may be 30% by mole or more and 50% by mole or less and is preferably 40% by mole or more and 50% by mole or less relative to the total polymerization components of the polyurethane rubber.

The low-molecular-weight polyol component is a polyol having a molecular weight (number-average molecular weight) of less than 500. The low-molecular-weight polyol is a material functioning as a chain extender and a crosslinking agent.

Examples of the low-molecular-weight polyol component include 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Of these, 1,4-butanediol is preferably used as the low-molecular-weight polyol component.

Examples of the low-molecular-weight polyol component further include diols (bifunctional), triols (trifunctional), and tetraols (tetrafunctional) that are known as chain extenders and crosslinking agents.

These polyols may be used alone or in combination of two or more thereof.

The polymerization ratio of the low-molecular-weight polyol component may be more than 50% by mole and 75% by mole or less, and is preferably 52% by mole or more and 75% by mole or less, more preferably 55% by mole or more and 75% by mole or less, still more preferably 55% by mole or more and 60% by mole or less relative to the total polymerization components of the polyurethane rubber.

Polyisocyanate Component

Examples of the polyisocyanate component include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylbiphenyl-4,4-diisocyanate (TODI).

The polyisocyanate component is more preferably 4,4'-diphenylmethane diisocyanate (MDI), 1,5-naphthalene diisocyanate (NDI), or hexamethylene diisocyanate (HDI).

These polyisocyanate components may be used alone or in combination or two or more thereof.

The polymerization ratio of the polyisocyanate component may be 5% by mole or more and 25% by mole or less and is preferably 10% by mole or more and 20% by mole or less relative to the total polymerization components of the polyurethane rubber.

Resin Having Functional Group Capable of Reacting with Isocyanate Group

The resin having a functional group capable of reacting with an isocyanate group (hereinafter referred to as a "functional group-containing resin") is preferably a flexible resin. In view of flexibility, the functional group-containing resin is more preferably an aliphatic resin having a linear structure. Specific examples of the functional group-containing resin include acrylic resins having two or more hydroxyl groups, polybutadiene resins having two or more hydroxyl groups, and epoxy resins having two or more epoxy groups.

Examples of commercially available products of the acrylic resins having two or more hydroxyl groups include ACTFLOW (grade: UMB-2005B, UMB-2005P, UMB-2005, UME-2005, and the like) available from Soken Chemical & Engineering Co., Ltd.

Examples of commercially available products of the polybutadiene resins having two or more hydroxyl groups include R-45HT and the like available from Idemitsu Kosan Co., Ltd.

The epoxy resins having two or more epoxy groups are preferably epoxy resins that have higher flexibility and toughness than usual epoxy resins but that do not have hard and brittle properties unlike usual typical epoxy resins. For example, in view of the molecular structure, the epoxy resins preferably have, in the main chain structure thereof, a structure (flexible skeleton) capable of increasing the mobility of the main chain. Examples of the flexible skeleton include alkylene skeletons, cycloalkane skeletons, and polyoxyalkylene skeletons. In particular, polyoxyalkylene skeletons are preferred.

In view of physical properties, epoxy resins having a low viscosity relative to the molecular weight as compared with usual epoxy resins are preferred. Specifically, the weight-average molecular weight is preferably in the range of 900±100, and the viscosity at 25° C. is preferably in the range of 15,000±5,000 mPa·s, more preferably in the range of 15,000±3,000 mPa·s. Examples of commercially available products of the epoxy resin having these properties include EPICLON EXA-4850-150 available from DIC Corporation.

The polymerization ratio of the functional group-containing resin may be within a range that does not impair the effect of the cleaning blade according to the exemplary embodiment.

Method for Producing Polyurethane Rubber

The polyurethane rubber is produced by a general method for producing polyurethane, such as a prepolymer method or a one-shot method. The prepolymer method is suitable for the present exemplary embodiment because polyurethane having good abrasion resistance and chipping resistance is produced, but the production method is not limited.

The cleaning blade is produced by molding a composition for forming a cleaning blade, the composition being prepared by the method described above, into a sheet shape by using, for example, centrifugal molding or extrusion molding, and then subjecting the resulting molded product to cutting or the like.

In this case, examples of a catalyst used for producing the polyurethane rubber include amine-based compounds such as tertiary amines, quaternary ammonium salts, and organometallic compounds such as organotin compounds.

Examples of the tertiary amines include trialkylamines such as triethylamine; tetraalkyldiamines such as N,N,N', N'-tetramethyl-1,3-butanediamine; aminoalcohols such as dimethylethanolamine; ester amines such as ethoxylated amines, ethoxylated diamines, and bis(diethylethanolamine) adipate; cyclohexylamine derivatives such as triethylenediamine (TEDA) and N,N-dimethylcyclohexylamine; morpholine derivatives such as N-methylmorpholine and N-(2-hydroxypropyl)-dimethylmorpholine; and piperazine derivatives such as N,N'-diethyl-2-methylpiperazine and N,N'-bis-(2-hydroxypropyl)-2-methylpiperazine.

Examples of the quaternary ammonium salts include 2-hydroxypropyltrimethylammonium octylate, 1,5-diazabicyclo[4.3.0]nonene-5 (DBN) octylate, 1,8-diazabicyclo[5.4.0]undecene-7 (DBU) octylate, DBU-oleates, DBU-p-toluenesulfonates, DBU-formates, and 2-hydroxypropyltrimethylammonium formate.

Examples of the organotin compounds include dialkyltin compounds such as dibutyltin dilaurate and dibutyltin di(2-ethylhexoate); stannous 2-ethylcaproate; and stannous oleate.

Of these catalysts, triethylenediamine (TEDA), which is a tertiary amine, may be used from the viewpoint of hydrolysis resistance, and quaternary ammonium salts may be used from the viewpoint of processability. Among quaternary ammonium salts, 1,5-diazabicyclo[4.3.0]nonene-5 (DBN) octylate, 1,8-diazabicyclo[5.4.0]undecene-7 (DBU) octylate, and DBU-formates, which have high reaction activity, are suitably used.

The content of the catalyst is preferably in the range of 0.0005% by mass or more and 0.03% by mass or less, particularly preferably 0.001% by mass or more and 0.01% by mass or less relative to the entire polyurethane rubber constituting the contact member.

These catalysts may be used alone or in combination of two or more thereof.

Physical Properties of Contact Member

The value of M100/Re of the contact member is 0.25 or more, preferably 0.28 or more, more preferably 0.3 or more. The upper limit of the value of M100/Re of the contact member is preferably 1.0 or less, more preferably 0.9 or less from the viewpoint of chipping resistance.

The rebound resilience coefficient Re [%] of the contact member is 25% or more, preferably 28% or more, more preferably 30% or more. The upper limit of the rebound resilience coefficient Re [%] of the contact member is preferably 60% or less, more preferably 40% or less from the viewpoint of the suppression of blade noise and abrasion resistance.

The 100% modulus M100 [MPa] of the contact member is preferably 4 MPa or more and 10 MPa or less, more preferably 5 MPa or more and 9 MPa or less from the viewpoint of abrasion resistance and chipping resistance.

When the value of M100/Re is 0.25 or more and the value of Re is 25 or more, the contact portion of the cleaning blade may be unlikely to be considerably caught in the transport direction of the intermediate transfer belt, and the phenomenon that the contact portion is unlikely to be returned from the considerably caught state may be suppressed as compared with the case where the value of Re is less than 25.

When the value of M100/Re is 0.25 or more and the value of Re is 25 or more, a micro-tucked-under space may be easily formed and a color streak, which is generated when a leading end of the cleaning blade is dragged, may be reduced as compared with the case where the value of M100/Re is less than 0.25 or more and the value of Re is less than 25.

The method for controlling the values of M100/Re and Re in the contact member is not particularly limited. For example, in the case where the contact member includes polyurethane rubber, the method may be a method of adjusting the values to the above ranges by appropriately selecting the types and the amounts of polymerization components of the polyurethane rubber and conditions for producing the polyurethane rubber.

The weight-average molecular weight of the contact member may be 1,000 or more and 4,000 or less and is preferably 1,500 or more and 3,500 or less.

The weight-average molecular weight is the value measured by gel permeation chromatography (GPC).

Composition of Non-Contact Member

When the cleaning blade includes the contact member and a region (hereinafter also referred to as a "non-contact member") other than the contact member, and the contact member and the non-contact member are composed of different materials, the composition of the non-contact member will be described.

The non-contact member is not particularly limited as long as the non-contact member has a function of supporting the contact member. Any publicly known material can be used for the non-contact member. Specific examples of the material used for the non-contact member include polyurethane rubber, silicone rubber, fluororubber, chloroprene rubber, and butadiene rubber. Of these, polyurethane rubber is preferred. Examples of the polyurethane rubber include ester-based polyurethane and ether-based polyurethane. In particular, ester-based polyurethane is preferred.

Production of Cleaning Blade

A cleaning blade having a single-layer structure is produced by, for example, the molding method for the contact member described above.

A cleaning blade having a two-layer structure or a cleaning blade having a three or more-layer structure is produced by, for example, bonding together a first layer functioning as the contact member and a second layer (plural layers in a layer structure including three or more layers) functioning as the non-contact member. In the bonding method, a double-sided tape, an adhesive, or the like is suitably used. Alternatively, plural layers may be bonded together by pouring materials of the layers into a mold while making a time difference during molding, and bonding together the materials without providing an adhesive layer.

Contact with Intermediate Transfer Belt

The cleaning blade is fixed in, for example, a cleaning case having an opening on the intermediate transfer belt side such that a leading end of the contact portion is disposed on the opening side. The cleaning case includes, for example, a transport member that guides, to a foreign substance-collecting container, foreign substances such as waste toner collected from the outer peripheral surface of the intermediate transfer belt by the cleaning blade.

The cleaning component may have two or more cleaning blades.

A contact pressure which is a force NF (normal force) to push the cleaning blade against the intermediate transfer belt is preferably in the range of 1.0 gf/mm or more and 4.0 gf/mm or less, more preferably in the range of 1.5 gf/mm or more and 3.5 gf/mm or less.

In addition, a biting length of the contact portion of the cleaning blade to the intermediate transfer belt is preferably in the range of 0.8 mm or more and 1.2 mm or less, more preferably in the range of 0.9 mm or more and 1.1 mm or less.

Transfer Device and Image Forming Apparatus

A transfer device according to the present exemplary embodiment includes a transfer unit that includes an intermediate transfer belt and a cleaning component that cleans an outer peripheral surface of the intermediate transfer belt, a first transfer section that first-transfers a toner image formed on a surface of an image carrier to a surface of the intermediate transfer belt of the transfer unit, and a second transfer section that second-transfers the toner image that is transferred to the surface of the intermediate transfer belt to a surface of a recording medium, in which the transfer unit described above is used as the transfer unit.

An image forming apparatus according to the present exemplary embodiment includes an image carrier, a charging device that charges a surface of the image carrier, an electrostatic latent image forming device that forms an electrostatic latent image on the charged surface of the image carrier, a developing device that houses a developer containing a toner and that develops the electrostatic latent image formed on the surface of the image carrier by using the developer to form a toner image, and a transfer device that transfers the toner image to a surface of a recording medium, in which the transfer device described above is used as the transfer device.

The image forming apparatus according to the present exemplary embodiment may be a common monochrome image forming apparatus including a developing device that houses only a monochrome toner, a color image forming apparatus that sequentially repeatedly first-transfers toner images carried on image carriers to an intermediate transfer belt, or a tandem-type color image forming apparatus in which plural image carriers including developing units for respective colors are arranged in tandem along an intermediate transfer belt.

FIGURE is a schematic diagram illustrating an example of an image forming apparatus according to the exemplary embodiment. The image forming apparatus illustrated in FIGURE is an image forming apparatus in which the endless belt in the transfer unit described above is applied to an intermediate transfer belt 107, and the cleaning blade in the transfer unit described above is applied to an intermediate transfer belt cleaning device 112.

Referring to FIGURE, an image forming apparatus 100 according to this exemplary embodiment is, for example, a so-called tandem system in which charging devices 102*a* to 102*d*, exposure devices 114*a* to 114*d*, developing devices 103*a* to 103*d*, first transfer devices (first transfer rollers) 105*a* to 105*d*, and image carrier cleaning devices 104*a* to 104*d* are sequentially arranged around four image carriers 101*a* to 101*d* formed of electrophotographic photoreceptors in the direction of rotation of the image carriers 101*a* to 101*d*. An erasing device may be provided in order to erase residual potential remaining on the surfaces of the image carriers 101*a* to 101*d* after transfer.

The intermediate transfer belt 107 is supported by support rollers 106*a* to 106*d*, a driving roller 111, and an opposing roller 108 so that a tension is applied to the intermediate transfer belt 107, thus forming a transfer unit 107*b*. The intermediate transfer belt 107 can be moved, by the support rollers 106*a* to 106*d*, the driving roller 111, and the opposing roller 108, between the image carriers 101*a* to 101*d* and the first transfer rollers 105*a* to 105*d* in the direction of an arrow A while being in contact with the surfaces of the image carriers 101*a* to 101*d*. Portions where the first transfer rollers 105*a* to 105*d* come in contact with the image carriers 101*a* to 101*d* with the intermediate transfer belt 107 therebetween function as first transfer portions. A first transfer voltage is applied to the contact portions of the image carriers 101*a* to 101*d* and the first transfer rollers 105*a* to 105*d*.

The opposing roller 108 and a second transfer roller 109 that are disposed so as to face each other with the intermediate transfer belt 107 and a second transfer belt 116 therebetween are provided as a second transfer device. The second transfer belt 116 is supported by the second transfer roller 109 and a support roller 106*e*. A recording medium 115 such as a paper sheet moves through a region sandwiched between the intermediate transfer belt 107 and the second transfer roller 109 in the direction of an arrow B while being in contact with the surface of the intermediate transfer belt 107, and then passes through a fixing device 110. A portion where the second transfer roller 109 comes in contact with the opposing roller 108 with the intermediate transfer belt 107 and the second transfer belt 116 therebetween functions as a second transfer portion. A second transfer voltage is applied to the contact portion between the second transfer roller 109 and the opposing roller 108. Furthermore, intermediate transfer belt cleaning devices 112 and 113 are disposed so as to come in contact with the intermediate transfer belt 107 after transfer.

In the multicolor image forming apparatus 100 having this structure, the image carrier 101*a* rotates in the direction of an arrow C, the surface of the image carrier 101*a* is charged by the charging device 102*a*, and an electrostatic latent image of a first color is then formed by the exposure device 114*a* such as a laser beam. The electrostatic latent image formed as described above is developed (visualized) with a developer containing a toner of the corresponding color by the developing device 103*a* that houses the toner so as to form a toner image. The developing devices 103*a* to 103*d* house toners corresponding to the electrostatic latent images of respective colors (for example, yellow, magenta, cyan, and black).

The toner image formed on the image carrier 101*a* is electrostatically transferred (first transfer) to the intermediate transfer belt 107 by the first transfer roller 105*a* when the toner image passes through the first transfer portion. Subsequently, toner images of a second color, a third color, and a fourth color are first-transferred to the intermediate transfer belt 107, which carries the toner image of the first color, by using the first transfer rollers 105*b* to 105*d* so that the toner images are sequentially superimposed. Consequently, a multicolor superimposed toner image is finally formed.

The superimposed toner image formed on the intermediate transfer belt 107 is collectively electrostatically transferred to the recording medium 115 transported by the second transfer belt 116 when the superimposed toner image passes through the second transfer portion. The recording medium 115 to which the toner image is transferred is transported to the fixing device 110, subjected to a fixing process by heating and/or pressing, and then discharged to the outside of the apparatus.

The residual toner on the image carriers 101*a* to 101*d* after the first transfer is removed by the image carrier cleaning devices 104*a* to 104*d*. On the other hand, the residual toner on the intermediate transfer belt 107 after the second transfer is removed by the intermediate transfer belt cleaning devices 112 and 113 so that the intermediate transfer belt 107 is prepared for the next image forming process.

Image Carrier

A wide variety of publicly known electrophotographic photoreceptors may be used as the image carriers 101*a* to 101*d*. The electrophotographic photoreceptors may be, for example, inorganic photoreceptors including photosensitive layers composed of inorganic materials or organic photoreceptors including photosensitive layers composed of organic materials. In the organic photoreceptors, function-separated organic photoreceptors in which a charge generation layer that generates charges due to exposure with light and a charge transport layer that transports charges are stacked or single-layer organic photoreceptors having a function of generating charges and a function of transporting charges are suitably used. In the inorganic photoreceptors, photoreceptors including photosensitive layers composed of amorphous silicon are suitably used.

The shape of each of the image carriers is not particularly limited, and a publicly known shape such as a cylindrical drum shape, a sheet shape, or a plate shape may be employed.

Charging Device

The charging devices 102*a* to 102*d* are not particularly limited, and a wide variety of publicly known chargers may be used. Examples thereof include contact-type chargers that use a conductive roller, brush, film, rubber blade, or the like, and scorotron and corotron chargers, which use corona discharge. Of these, the contact-type chargers are preferred.

The charging devices 102*a* to 102*d* typically apply a direct current to the image carriers 101*a* to 101*d*, respectively. Alternatively, the charging devices 102*a* to 102*d* may apply a direct current on which an alternating current is superimposed to the image carriers 101*a* to 101*d*, respectively.

Exposure Device

The exposure devices 114*a* to 114*d* are not particularly limited, and a wide variety of publicly known exposing devices may be used. Examples thereof include light sources such as semiconductor laser light, light emitting diode (LED) light, and liquid crystal shutter light, and optical devices capable of exposing a predetermined image pattern by using light from any of these light sources through a polygon mirror.

Developing Device

The developing devices 103*a* to 103*d* are selected according to the purpose. Examples thereof include publicly known developing units that develop one-component developers or two-component developers in a contact or non-contact manner by using brush, rollers, or the like.

First Transfer Roller

The first transfer rollers 105*a* to 105*d* may each be constituted by a single layer or plural layers. For example, in the case where the first transfer rollers 105*a* to 105*d* have a single-layer structure, the first transfer rollers may be rollers composed of foamed or non-foamed rubber such as silicone rubber, urethane rubber, or EPDM containing a suitable amount of conductive particles such as carbon black.

Image Carrier Cleaning Device

The image carrier cleaning devices 104*a* to 104*d* are devices for removing residual toner adhering to the surfaces of the image carriers 101*a* to 101*d* after the first transfer step. Besides cleaning blades, brush cleaning, roller cleaning, or the like may be used. Of these, cleaning blades are preferably used. Examples of the material of the cleaning blades include urethane rubber, neoprene rubber, and silicone rubber.

Second Transfer Roller

The layer structure of the second transfer roller 109 is not particularly limited. For example, in the case where the second transfer roller 109 has a three-layer structure, the second transfer roller 109 is constituted by a core layer, an intermediate layer, and a coating layer covering the surface of the intermediate layer. The core layer is composed of a foamed rubber such as silicone rubber, urethane rubber, or EPDM in which conductive particles are dispersed, and the intermediate layer is composed of non-foamed rubber such as silicone rubber, urethane rubber, or EPDM. Examples of the material of the coating layer include tetrafluoroethylene-hexafluoropropylene copolymers and perfluoroalkoxy resins. The second transfer roller 109 preferably has a volume resistivity of $10^7$ Ωcm or less. Alternatively, the second transfer roller 109 may have a two-layer structure excluding the intermediate layer.

Opposing Roller

The opposing roller 108 forms a counter electrode for the second transfer roller 109. The opposing roller 108 may have a single-layer structure or a multilayer structure. For example, in the case where the opposing roller 108 has a single-layer structure, the opposing roller 108 may be a roller composed of rubber such as silicone rubber, urethane rubber, or EPDM containing a suitable amount of conductive particles such as carbon black. In the case where the opposing roller 108 has a two-layer structure, the opposing roller 108 may be a roller constituted by an elastic layer composed of the rubber material described above and a high-resistance layer covering an outer peripheral surface of the elastic layer.

A voltage of 1 kV or more and 6 kV or less is usually applied to the cores of the opposing roller 108 and the second transfer roller 109. A voltage may be applied to the second transfer roller 109 and a highly conductive electrode member that is brought into contact with the opposing roller 108 instead of applying a voltage to the core of the opposing roller 108. The electrode member may be a metal roller, a conductive rubber roller, a conductive brush, a metal plate, a conductive resin plate, or the like.

Fixing Device

A wide variety of publicly known fixing units may be used as the fixing device 110. The fixing device 110 may be, for example, a heat roller fixing unit, a pressure roller fixing unit, or a flash fixing unit.

Intermediate Transfer Belt Cleaning Device

The intermediate transfer belt cleaning device 112 is the cleaning blade in the transfer unit described above.

Besides the cleaning blade, brush cleaning, roller cleaning, or the like may be used as the intermediate transfer belt cleaning device 113.

The exemplary embodiments have been described above. It is to be understood that the exemplary embodiments are not restrictive, and various modifications, variations, and improvements may be made to the exemplary embodiments.

EXAMPLES

Examples of the present disclosure will now be described, but the present disclosure is not limited to the following Examples. In the following description, "part" and "%" are all on a mass basis, unless otherwise specified. Production of Intermediate Transfer Belt (Endless Belt) Production of Intermediate Transfer Body A To 1,000 g of a wholly aromatic polyimide varnish (solid content: 18% by weight, U-Imide KX, solvent: NMP, available from UNITIKA LTD.,), 38 g (21 phr) of oxidation-treated gas black (channel black, FW200, number-average primary particle size: 13 nm, available from Orion Engineered Carbons) is added as first conductive carbon particles. Dispersion treatment of the resulting mixture is performed as follows by using a high-pressure collision-type disperser (available from Genus). The mixture is allowed to pass through an orifice with a diameter # of 0.1 mm at a pressure of 200 MPa, the resulting slurry is divided into two portions, and the slurry portions are allowed to collide with each other. This operation is conducted five times to prepare a coating liquid A which is a first coating liquid.

The coating liquid A prepared as described above is applied to an outer surface of a SUS pipe with a diameter # of 429.5 by a flow coating method so as to have a predetermined thickness and dried at 150° C. for 30 minutes while the SUS pipe is rotated. Subsequently, the SUS pipe is placed in an oven at 340° C. for one hour and then removed from the oven. Thus, the SUS pipe having an endless belt A on the outer surface thereof is obtained. The endless belt A has a total film thickness (that is, a film thickness of the single layer) of 80 μm.

The endless belt A formed on the outer surface is removed from the SUS pipe and cut to have a width of 360 mm. Thus, an intermediate transfer body A which is a belt-shaped intermediate transfer body is obtained. The content of the conductive carbon particles relative to the entire intermediate transfer body A is 17% by mass.

The volume resistivity and the surface resistivity of the outer peripheral surface of the intermediate transfer body A are measured by the methods described above. According to the results, the common logarithm of the volume resistivity is 10.1 (log Ω·cm), and the common logarithm of the surface resistivity is 10.5 (log Ω/sq.).

Production of Intermediate Transfer Body B

An endless belt B and an intermediate transfer body B are obtained as in the endless belt A and the intermediate transfer body A, respectively, except that oxidation-treated gas black (channel black, SB6, available from Orion Engineered Carbons) is used instead of the oxidation-treated gas black (FW200, available from Orion Engineered Carbons).

The endless belt B has a total film thickness (that is, a film thickness of the single layer) of 78 μm.

The content of the conductive carbon particles relative to the entire intermediate transfer body B is 20% by mass. The common logarithm of the volume resistivity of the intermediate transfer body B is 10.3 (log Ω·cm). The common logarithm of the surface resistivity of the intermediate transfer body B is 10.8 (log Ω/sq.).

Production of Intermediate Transfer Body C

An endless belt C and an intermediate transfer body C are obtained as in the endless belt A and the intermediate transfer body A, respectively, except that in the drying step, heating is performed at 150° C. for 15 minutes by using a slit nozzle instead of drying by rotation at 150° C. for 30 minutes.

The endless belt C has a total film thickness (that is, a film thickness of the single layer) of 81 μm.

The content of the conductive carbon particles relative to the entire intermediate transfer body C is 17% by mass. The common logarithm of the volume resistivity of the intermediate transfer body C is 10.1 (log Ω·cm). The common logarithm of the surface resistivity of the intermediate transfer body C is 10.4 (log Ω·sq.).

Production of Intermediate Transfer Body D

An endless belt D and an intermediate transfer body D are obtained as in the endless belt A and the intermediate transfer body A, respectively, except that drying is performed by rotation at 130° C. for 45 minutes instead of drying by rotation at 150° C. for 30 minutes.

The endless belt D has a total film thickness (that is, a film thickness of the single layer) of 81 μm.

The content of the conductive carbon particles relative to the entire intermediate transfer body D is 17% by mass. The common logarithm of the volume resistivity of the intermediate transfer body D is 10.2 (log Ω·cm). The common logarithm of the surface resistivity of the intermediate transfer body D is 10.6 (log Ω/sq.).

Production of Intermediate Transfer Bodies E and F

Endless belts E and F and intermediate transfer bodies E and F are obtained as in the endless belt A and the intermediate transfer body A, respectively, except that heating is performed at 165° C. by using a slit nozzle instead of drying by rotation at 150° C. for 30 minutes. In the endless belt E, the time during heating with the slit nozzle is 12 minutes. In the endless belt F, the time during heating with the slit nozzle is 10 minutes.

The endless belts E and F each have a total film thicknesses (that is, a film thickness of the single layer) of 80 μm.

The content of the conductive carbon particles relative to the entire intermediate transfer body E and the content of the conductive carbon particles relative to the entire intermediate transfer body F are each 17% by mass. The common logarithms of the volume resistivities of the intermediate transfer bodies E and F are each 10.1 (log Ω·cm). The common logarithms of the surface resistivities of the intermediate transfer bodies E and F are each 10.5 (log Ω/sq.).

Production of Intermediate Transfer Body G

An endless belt G and an intermediate transfer body G are obtained as in the endless belt A and the intermediate transfer body A, respectively, except that oxidation-treated gas black (channel black, SB4, available from Orion Engineered Carbons) is used instead of the oxidation-treated gas black (FW200, available from Orion Engineered Carbons).

The endless belt G has a total film thickness (that is, a film thickness of the single layer) of 80 μm.

The content of the conductive carbon particles relative to the entire intermediate transfer body G is 16% by mass. The common logarithm of the volume resistivity of the intermediate transfer body G is 10.3 (log Ω·cm). The common logarithm of the surface resistivity of the intermediate transfer body G is 10.9 (log Ω/sq.).

Production of Cleaning Blade

Production of Cleaning Blades 1 to 6

Cleaning blades each formed of a single layer are produced by changing the types and the molar ratios of a high-molecular-weight polyol component, a low-molecular-weight polyol component, an isocyanate component, and a crosslinking agent, and changing a curing/aging condition in accordance with Table 1. Specifically, the cleaning blades are produced as follows.

First, adipic acid (HOOC—$C_4H_8$—COOH) is polymerized with 1,4-butanediol at 1:1 (molar ratio), and the resulting polymer is treated so that a terminal thereof has an —OH group, thus producing a polyester polyol by polymerization of a linear diol having 4 carbon atoms (butanediol). The resulting polyester polyol had a number-average molecular weight of 2,000.

Next, the polyester polyol serving as a high-molecular-weight polyol component, 1,4-butanediol (1,4-BD, chain extender) serving as a low-molecular-weight polyol component, 4,4'-diphenylmethane diisocyanate (MDI, polyisocyanate, Millionate MT, available from Tosoh Corporation) serving as an isocyanate component, and trimethylolpropane (TMP, available from Mitsubishi Gas Chemical Company, Inc.) serving as a crosslinking agent are allowed to react in blending amounts (molar ratio) shown in Table 1 in a nitrogen atmosphere at 80° C. for two hours to prepare a composition A1 for forming a cleaning blade.

Subsequently, the composition A1 for forming a cleaning blade is poured into a centrifugal molding machine having a die adjusted to 140° C., and cured and then aged by heating under the curing/aging condition shown in Table 1. Subsequently, the cooled cured product is cut to produce a cleaning blade having a width of 8 mm and a thickness of 2 mm.

The curing/aging conditions A to D shown in Table 1 are as follows.

Curing/aging condition A: curing reaction at 100° C. for one hour and then aging by heating at 110° C. for 24 hours Curing/aging condition B: curing reaction at 110° C. for one hour and then aging by heating at 110° C. for 24 hours Curing/aging condition C: curing reaction at 110° C. for two hours and then aging by heating at 110° C. for 48 hours Curing/aging condition D: curing reaction at 100° C. for 40 minutes and then aging by heating at 100° C. for 24 hours

TABLE 1

| Cleaning blade | | 1 | 2 | 3 | 4 | 5 | 6 |
|---|---|---|---|---|---|---|---|
| High-molecular-weight polyol | Type | Polyester polyol (Adipate) | Polyester polyol (Adipate) | Polyester polyol (Adipate) | Polyester polyol (Adipate) | Polyester polyol (Adipate) | Polyester polyol (Adipate) |
| | mol % | 45 | 30 | 35 | 48 | 23 | 45 |
| Low-molecular-weight polyol | Type | 1,4-BD | 1,4-BD | 1,4-BD | 1,4-BD | 1,4-BD | 1,4-BD |
| | mol % | 55 | 70 | 65 | 52 | 77 | 55 |
| Isocyanate | Type | MDI | MDI | MDI | MDI | MDI | MDI |
| | mol % | 18 | 18 | 18 | 18 | 18 | 18 |
| Crosslinking agent | Type | TMP | TMP | TMP | TMP | TMP | TMP |
| | mol % | 0.8 | 0.5 | 1.2 | 0.8 | 0.3 | 1.3 |
| Ratio of 1,4-BD relative to total polyols | | 55% | 70% | 65% | 52% | 77% | 55% |
| Curing/aging condition | | A | A | B | A | D | C |

Measurement of Intermediate Transfer Belt and Cleaning blade

The L(r) integrated value in each of the intermediate transfer belts, the value of M100/Re in each of the cleaning blades, and the value of Re in each of the cleaning blades are measured by the methods described above. Table 2 shows the results.

Production of Image Forming Apparatus

Image forming apparatuses of Examples 1 to 4 and Comparative Examples 1 to 3 are each prepared by incorporating a combination of an intermediate transfer belt and a cleaning blade shown in Table 2 in a modified apparatus (that is, a modified apparatus prepared by mounting the intermediate transfer belt and then adjusting the cleaning blade in accordance with a belt film thickness) of an image forming apparatus (DocuColor-7171P, available from Fuji Xerox Co., Ltd.).

The contact pressure which is a force NF to push the cleaning blade against the intermediate transfer belt is 1.1 gf/mm.

Evaluation of Transfer Unit

Evaluation of Transferability to Textured Paper

A blue color solid image is formed on textured paper (LEATHAC 66, 204 gsm) in an environment at a temperature of 22° C. and a humidity of 55%, and the image quality at the initial stage (initial image quality) is evaluated by visual observation. Furthermore, the solid image is formed on 10,000 sheets, and the image quality in the image on the 10,000th sheet (image quality after 10 kPV) is evaluated by visual observation. The evaluation criteria are shown below. Table 2 shows the results.

Evaluation Criteria

A: Neither transfer unevenness nor a color streak is observed.

B: Very slight transfer unevenness is generated.

C: Unacceptable transfer unevenness is generated.

D: A color streak is generated.

TABLE 2

| | | Example 1 | Example 2 | Example 3 | Example 4 | Comparative Example 1 | Comparative Example 2 | Comparative Example 3 |
|---|---|---|---|---|---|---|---|---|
| Intermediate transfer belt | Belt | A | B | C | D | E | F | G |
| | L(r) integrated value | 0.06 | 0.08 | 0.07 | 0.10 | 0.04 | 0.05 | 0.15 |
| Cleaning blade | Blade | 1 | 2 | 3 | 4 | 5 | 6 | 1 |
| | M100 | 9.0 | 9.5 | 8.0 | 9.1 | 9.8 | 7.0 | 9.0 |
| | Re | 28 | 25 | 32 | 27 | 20 | 32 | 28 |
| | M100/Re | 0.32 | 0.38 | 0.25 | 0.34 | 0.54 | 0.22 | 0.32 |
| Evaluation | Initial image quality | A | A | A | B | A | A | C |
| | Image quality after 10 kPV | A | B | B | B | C | D | C |

The results shown in Table 2 show that the transfer units of Examples exhibit a higher ability to maintain transferability than the transfer units of Comparative Examples when a recording medium with large surface irregularities is used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer unit comprising:

an intermediate transfer belt which is an endless belt including a resin and conductive carbon particles and in which in a spatial distribution of the conductive carbon particles that are present in an evaluation region of 6.3 μm×4.2 μm on an outer peripheral surface, an integrated value of a statistic L(r) represented by a formula (1) below in an interparticle distance r of 0.05 μm or more and 0.30 μm or less is 0 or more and 0.1 or less; and a cleaning component configured to clean the outer peripheral surface, the cleaning component including a cleaning blade configured to contact the outer peripheral surface and in which a value of M100/Re is 0.25 or more and a value of Re is 25 or more where M100 represents a 100% modulus (MPa) of a contact portion of the cleaning blade configured to contact the intermediate transfer belt, and Re represents a rebound resilience coefficient (%) of the contact portion:

$$L(r) := \sqrt{K(r)/\pi} - r \tag{1}$$

where r represents the interparticle distance, and K(r) represents a Ripley's K function K(r) represented by a formula (2) below:

$$K(r) := \frac{\sum_{i \neq j}^{N} 1(|X_i - X_j| \leq r)/s(|X_i - X_j|)}{\lambda^2} \tag{2}$$

where $1(|X_i - X_j| \leq r)$ represents an indicator function; $X_i$ and $X_j$ represent coordinates of a point i and a point j, respectively; $|X_i - X_j|$ represents a Euclidean distance between the coordinates $X_i$ and the coordinates $X_j$; r represents the interparticle distance; $s(|X_i - X_j|)$ represents an edge correction factor s(x) in the evaluation region, the edge correction factor s(x) being represented by a formula (3) below, where $x = |X_i - X_j|$; N represents a total number of particles in the evaluation region; and λ represents a number density of particles in the evaluation region:

$$s(x) := L_x L_y - \frac{x}{\pi}(2L_x + 2L_y - x) \tag{3}$$

where $L_x$ and $L_y$ represent a length (μm) of a side of the evaluation region in an x-axis direction and a length (μm) of a side of the evaluation region in a y-axis direction, respectively; $x = |X_i - X_j|$; $X_i$ and $X_j$ represent coordinates of the point i and the point j, respectively; and $|X_i - X_j|$ represents the Euclidean distance between the coordinates $X_i$ and the coordinates $X_j$.

2. The transfer unit according to claim 1, wherein the resin includes at least one selected from the group consisting of: polyimide resins, polyamide-imide resins, aromatic polyether ether ketone resins, polyphenylene sulfide resins, and polyetherimide resins.

3. The transfer unit according to claim 2, wherein the resin includes a polyimide resin.

4. The transfer unit according to claim 3, wherein the conductive carbon particles have a number-average primary particle size of 10 nm or more and 20 nm or less.

5. The transfer unit according to claim 4, wherein the conductive carbon particles have the number-average primary particle size of 10 nm or more and 15 nm or less.

6. The transfer unit according to claim 3, wherein the conductive carbon particles are channel black.

7. The transfer unit according to claim 3, wherein a contact pressure of the cleaning blade to the intermediate transfer belt is 1.0 gf/mm or more and 4.0 gf/mm or less.

8. The transfer unit according to claim 2, wherein the conductive carbon particles have a number-average primary particle size of 10 nm or more and 20 nm or less.

9. The transfer unit according to claim 8, wherein the conductive carbon particles have number-average primary particle size of 10 nm or more and 15 nm or less.

10. The transfer unit according to claim 2, wherein the conductive carbon particles are channel black.

11. The transfer unit according to claim 2, wherein a contact pressure of the cleaning blade to the intermediate transfer belt is 1.0 gf/mm or more and 4.0 gf/mm or less.

12. The transfer unit according to claim 1, wherein the conductive carbon particles have a number-average primary particle size of 10 nm or more and 20 nm or less.

13. The transfer unit according to claim 12, wherein the conductive carbon particles have the number-average primary particle size of 10 nm or more and 15 nm or less.

14. The transfer unit according to claim 13, wherein a contact pressure of the cleaning blade to the intermediate transfer belt is 1.0 gf/mm or more and 4.0 gf/mm or less.

15. The transfer unit according to claim 12, wherein the conductive carbon particles are channel black.

16. The transfer unit according to claim 12, wherein a contact pressure of the cleaning blade to the intermediate transfer belt is 1.0 gf/mm or more and 4.0 gf/mm or less.

17. The transfer unit according to claim 1, wherein the conductive carbon particles are channel black.

18. The transfer unit according to claim 1, wherein a contact pressure of the cleaning blade to the intermediate transfer belt is 1.0 gf/mm or more and 4.0 gf/mm or less.

19. A transfer device comprising:

the transfer unit according to claim 1;

a first transfer section configured to first-transfer a toner image formed on a surface of an image carrier to a surface of the intermediate transfer belt of the transfer unit; and a second transfer section configured to second-transfer the toner image that is transferred to the surface of the intermediate transfer belt to a surface of a recording medium.

20. An image forming apparatus comprising:

an image carrier;

a charging device configured to chare a surface of the image carrier;

an electrostatic latent image forming device configured to form an electrostatic latent image on the charged surface of the image carrier;

a developing device configured to house a developer containing a toner, wherein the developing device is configured to develop the electrostatic latent image formed on the surface of the image carrier by using the developer to form a toner image; and a transfer device configured to transfer the toner image to a surface of a recording medium, the transfer device being the transfer device according to claim 19.

* * * * *